US005294213A

United States Patent [19]

Parks

[11] Patent Number: 5,294,213

[45] Date of Patent: Mar. 15, 1994

[54] COASTAL STABILIZATION WITH MULTIPLE FLOW CONTROL

[76] Inventor: James M. Parks, 3509 Merrick Ct., #210, Lexington, Ky. 40502

[21] Appl. No.: 948,050

[22] Filed: Sep. 21, 1992

Related U.S. Application Data

[63] Continuation-in-part of Ser. No. 696,044, May 6, 1991, Pat. No. 5,149,227, which is a continuation-in-part of Ser. No. 488,683, Mar. 5, 1990, Pat. No. 5,061,117.

[51] Int. Cl.[5] ..... E02B 3/02

[52] U.S. Cl. ..... 405/73; 405/21; 405/52

[58] Field of Search ..... 405/73, 74, 21, 52, 405/15

[56] References Cited

U.S. PATENT DOCUMENTS 4,074,535 2/1978 Schoonmaker ..... 405/74
4,645,377 2/1987 Vesterby ..... 405/74
4,898,495 2/1990 Lin ..... 405/73
5,022,784 6/1991 DeVries et al. ..... 405/74 X

*Primary Examiner*—Dennis L. Taylor
*Attorney, Agent, or Firm*—Charles A. McClure

[57] ABSTRACT

Coastal stabilization with multiple flow control of water to and from foraminous pipes and adjacent subsoil. Offshore underwater subsoil is fluidized by injection of water via underlying foraminous piping, thereby increasing the concentration of subsoil suspended in the overlying water during its onrush onto the shore. Under normal conditions beach subsoil is dewatered by withdrawing water therefrom via adjacent foraminous piping, and under stormy conditions subsoil further onshore is dewatered via foraminous piping adjacent thereto, inducing deposition of the suspended subsoil onto the adjacent land. Water collected by such dewatering can be stored temporarily and be discharged by use in such fluidization or be discharged to the sea.

16 Claims, 5 Drawing Sheets

COASTAL STABILIZATION WITH MULTIPLE FLOW CONTROL

This is a continuation-in-part of my copending application, Ser. No. 696,044, filed 6 May 1991, to issue as U.S. Pat. No. 5,149,227, which was a continuation-in-part of my prior application, Ser. No. 488,683, filed 5 Mar. 1990, now U.S. Pat. No. 5,061,117.

TECHNICAL FIELD

This invention relates to coastal stabilization, as in beaches, by control of sand washing onshore and of sand backwashing offshore.

BACKGROUND OF THE INVENTION

Under normal conditions, nature's transport of non-cohesive sub-soil (such as sand) periodically to and onto a beach and off or away from the beach is at—or close to—equilibrium (zero net transport). Seasonal or other variations may tend either to remove sand (erosion by negative net transport) or to replace it (accretion by positive net transport) for substantial periods of time but often average out over a few years if not during each individual year. Beach accretion is hardly ever a cause for concern, but continuing or repeated beach erosion occasions financial and esthetic losses, greatly disturbing landowners, municipalities, tourists, etc.

Beachface dewatering has been known for many years as conducive to accretion, as shown in the technical literature and in patents, such as Vesterby U.S. Pat. No. 4,645,377, Lin U.S. Pat. No. 4,898,495, and more recently in the present inventor's noted U.S. Pat. No. 5,061,117.

Dewatering of the beachface at a level just below mean low water is beneficial by removing part of the overlying water in which non-cohesive subsoil is suspended, thereby increasing the concentration of suspended subsoil in the suspending water, whereupon a bit more of such subsoil than usual is deposited on the beachface during wave onrush and a bit less than usual is removed during the ensuing backwash. Such dewatering need not be continuous but only frequent enough to assure that on the average the beach receives as much sand as it loses—or, if possible, appreciably more than it loses.

Some of the worst beach erosion occurs suddenly, during storms in which great expanses of beach are carried away. The disruptive effect of storms may be ameliorated somewhat by building a beach outward during normal times to provide a buffer or sacrificial zone. Retention of excess sand on the beach so as to appease nature's appetite when on a rampage is generally prudent and much better than periodically dredging up sand and depositing it onto the beach, only to be carried off in a few months. Whether the most violent storms can be neutralized is doubtful, but the present invention extends my previous inventions to enhance day-to-day net accretion, and also to reduce loss from inclement weather effects of diverse magnitudes.

SUMMARY OF THE INVENTION

A primary object of the present invention is to counteract the capacity of a storm for carrying off much of the sand from a beach.

Another object of this invention is to stabilize a beach by increasing the amount of sand washing onshore.

A further object of the invention is to stabilize a beach by decreasing the amount of sand backwashing offshore.

Yet another object of this invention is to provide standby or back-up emergency capacity to a beach subsoil dewatering system.

A further object is to combine emergency onshore subsoil dewatering with offshore subsoil fluidization.

In general, the objects of the present invention are attained, in stabilizing beaches, by controlling water flow laterally through multiple openings in the wall of foraminous piping. Such flow is either from outside to inside (dewatering) or, alternatively, from inside to outside (fluidization) and takes place at a plurality of water-interchange sites along a coastline or shoreline, itself often defined substantially coincident with the mean high water contour.

An example is dewatering intertidal and/or near onshore subsoil to maintain beach extent without substantial net loss of subsoil, under normal conditions, but under stormy conditions dewatering the subsoil further onshore and simultaneously fluidizing underwater subsoil to raise subsoil concentrations in the water washing onshore.

More particularly, such objects are accomplished along a coast by means of a plurality of foraminous piping water-interchange means buried at spaced distances from the shoreline. The coastal area may be thought of as divided into an offshore region and an onshore region sandwiching an intertidal zone from mean low water (MLW) to mean high water (MHW)—respectively below and above an intervening Mean Sea Level (MSL). Stippling above MSL (here to the left) indicates the usually exposed sandy surface. The offshore (underwater) region is conveniently subdivided into a near offshore strip (MLW-contiguous) and an adjacent further offshore strip. The onshore region is conveniently subdivided into a usually dry near onshore sandy and/or gravelly strip (MHW-contiguous) and an almost always dry further onshore strip—often with dunes and/or vegetation. The "beach" may be understood to include adjacent parts of the intertidal zone and near onshore strip, if not all of either or both.

In a preferred embodiment of the invention, foraminous piping means are located at or below mean sea level, by being buried in the onshore subsoil, being submerged in the water offshore, and being buried and/or submerged in in or along the intertidal zone. The foraminous piping means are connected to pumping means and are valved to dewater beach and/or near onshore subsoil and thereby preclude substantial net loss of beach subsoil under normal conditions. Under one set of storm conditions the foraminous piping means are pumped and valved to dewater bach and/or further onshore subsoil, and to fluidize near offshore subsoil and either intertidal or further offshore subsoil to raise subsoil concentration in onrushing waves, and so ameliorate storm loss of beach extent.

Preferably foraminous piping means are buried in as many as five locations: intertidal zone, near onshore, further (or far) onshore, near offshore, and further (far) offshore. Other objects of the present invention, together with means and methods for attaining the various objects, will be apparent from the following description and accompanying diagrams of preferred embodiments, which are presented by way of example rather than limitation.

DESCRIPTION OF THE INVENTION

Figure 1:
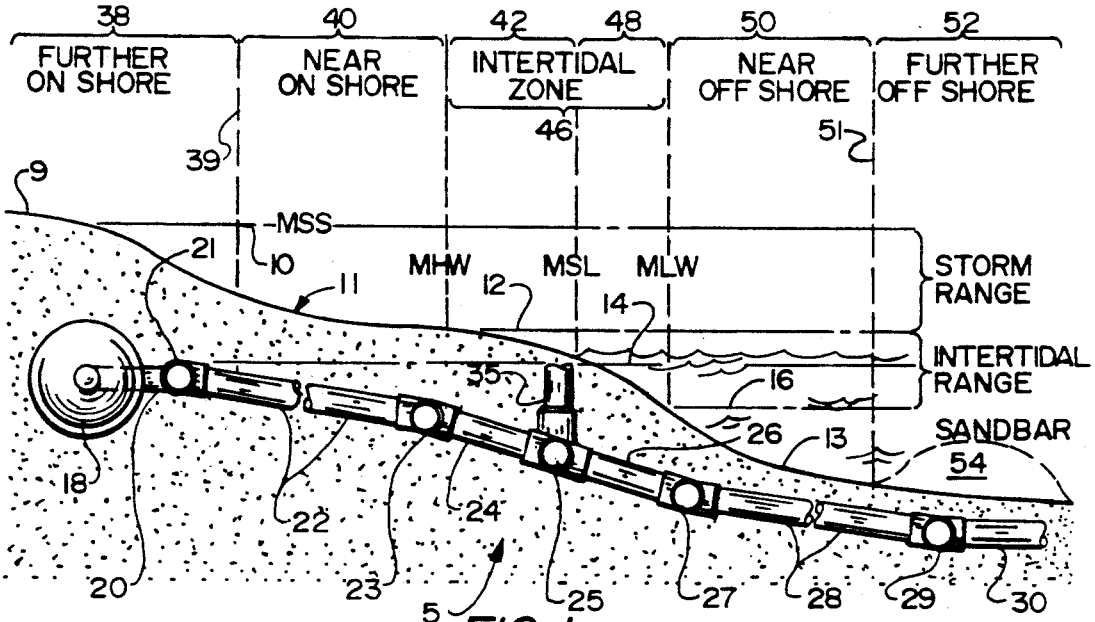
FIG. 1 is a schematized side sectional elevation of apparatus of this invention underlying an intertidal zone and its adjoining near and far onshore vicinity and near and far offshore vicinity.
Figure 2:
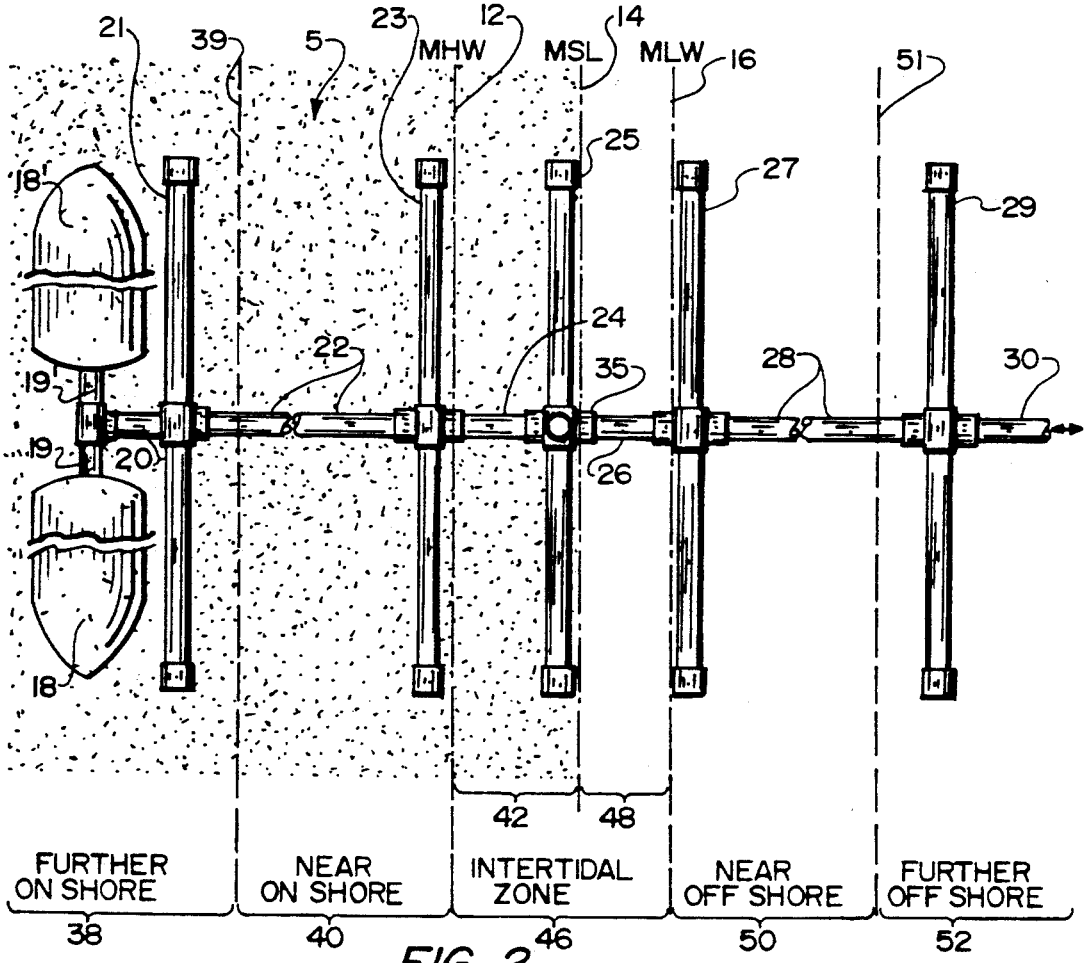
FIG. 2 is a plan view corresponding to FIG. 1.

FIG. 1 shows in schematized side sectional elevation, and FIG. 2 shows in plan, piping assembly 5 of this invention, installed underlying land surface 11, which terminates at the left in dune 9 and at the right in underwater land/water interface 13. At the far left are buried water storage means 18, 18' connected together by pipes 19, 19' and teed to pipe 20 leading to first foraminous pipe 21 of a parallel array of five such pipes: 21, 23, 25, 27, 29. These pipes are closed at their ends but are interconnected medially in sequence by non-foraminous pipes 22, 24, 26, 28. Rising from interconnection to foraminous pipe 25 is non-foraminous pipe 26 to auxiliary water storage means (not shown), and at the right is inlet/outlet pipe 30 connected to last foraminous pipe 29. No attempt is made in either Fig, to show the openings through the walls of the foraminous pipes.

Across the top of FIG. 1 and split between the top and the bottom of FIG. 2 are identifiers for successive subdivisions of the full horizontal extent of the views, at at the right in FIG. 1 are identifiers for defined water levels and associated height ranges. Mean sea level (MSL) is shown at about illustrated water level 14, is underlain at some height increment by mean low water (MLW) level 16 and overlain at another height increment by mean high water (MHW) level 12, which in turn is overlain at a further height increment by maximum storm surge MSS level 10.

Reflected vertically from intersections of the mentioned levels with the land surface are these corresponding strips viewed in plan: Intertidal Zone 46, as the sum of usually dry strip 42 (between the MSL and MHW contours) and usually wet strip 48 (between the MSL and MLW contours). Just to the left of the Intertidal Zone is Near Onshore strip 40, bordered (at 39) by Further (or Far) Onshore strip 38, both of which are wetted in the event of a Storm Range water level rise. Just to the right of the Intertidal Zone is Near Offshore strip 50, bordering (at 51) Further or Far Offshore strip 52.

Piping assembly 5 slopes downward from left to right, more or less parallel to the land gradient, as shown in FIG. 1. Shown in broken lines, overlying the site of last foraminous pipe 29, is Sand Bar 54, which tends to form offshore, especially after storm surges. Parts of the interconnecting (non-foraminous) piping are cut away to indicate that the illustrated foraminous pipe spacing is not drawn to scale but is condensed for convenience of illustration. The same is true of the Storm Storage means, which may be very extensive. As noted, the beach conventionally includes the upper part or even all of the Intertidal Zone plus part or all of the Near Onshore strip.

The Storm Storage means underlies the part of the Far Onshore strip representing the furthest extent of storm water runup, about at the base of dune 9 and may be located at or even above MSL, but the foraminous piping is preferably located lower, for gravity flow from the storage means and to facilitate dewatering use as the water table is normally closely associated with, if not the same as, MSL.

The interconnecting non-foraminous pipes are preferably orthogonal to the foraminous pipes, which are mutually substantially parallel and also substantially parallel to the surface contours. The interconnecting pipe fittings retain the respective pipes in place: four-way for foraminous pipe 21 junction to pipes 20 and 22, foraminous pipe 23 junction to pipes 22 and 24, foraminous pipe 27 junction to pipes 26 and 28, and foraminous pipe 29 junction to pipe 28 and inlet/outlet pipe 30 (partly cut away). Foraminous pipe 25 has a five-way fitting for junction to pipes 24 and 26, also vertical pipe 35 to auxiliary storage means. The fittings accommodate valving and pumping means (not visible here) for controlling flow of water from one or more of the pipes to one of more of the other pipes, as shown schematically in the next view. Tee and cross fittings are readily available in suitable materials to make up simple piping arrangements. If more complex (e.g., five-way) fittings are not at hand they may be built up by appropriate interconnection of the standard simpler fittings, as is well known.

Figure 3:
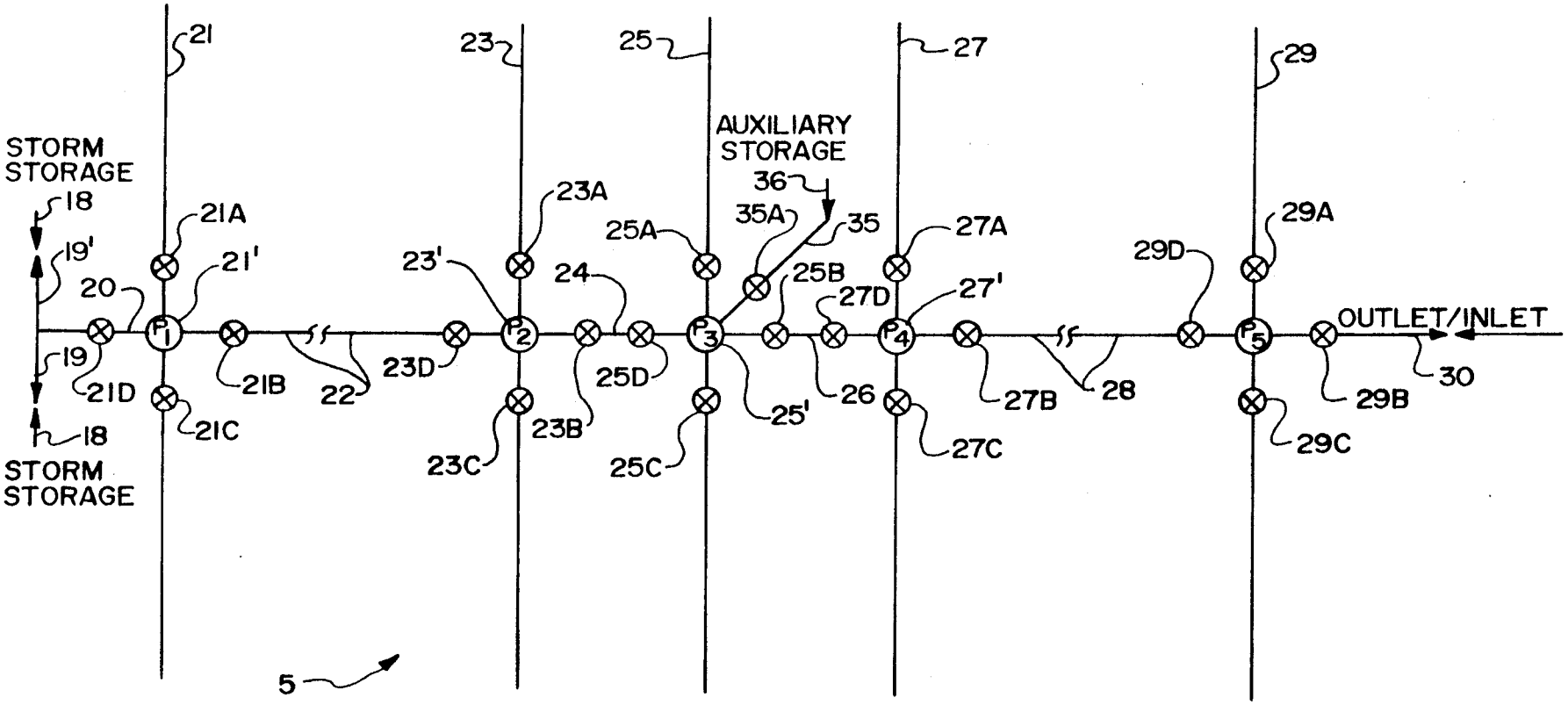
FIG. 3 is a schematized plan view corresponding to FIG. 2.

FIG. 3 is a plan view, quite similar in layout to FIG. 2 but with the piping single-lined and with valves (x) shown in the various pipes, designated by the foraminous piping number followed by one of suffixes a, b, c, d for valves in the pipes clockwise from the 12 o'clock position, and by pumps (P) at the various junctions, designated by the foraminous piping number primed: e.g., 21' at the junction of foraminous pipe 21 and non-foraminous pipes 20 and 22, with valves **21*a*, 21*b*, 21*c*, and 21*d* clockwise around pump 21'**.

Water flow into, through, and out of the foraminous piping means is aided by one or more included pumping means. Auxiliary Storage 36 and Storm Storage 18, 18' water reservoirs are provided, into and out of which water may be pumped, as well as at least one offshore water inlet/outlet, each with appropriate valving. Valves and pumping means are actuatable by conventional electrical, pneumatic, hydraulic, or mechanical means and methods, all in accordance with ambient conditions and/or otherwise preselected timing cycles.

Some pumps have multiple—even reversible—intake and discharge ports and valves, and thus are especially convenient for use according to this invention. In their absence, additional pumps may prove less expensive and more convenient, and their interconnection to the pipes and valves readily apparent, as as customary in flow control. It is assumed here that a non-operating pump offers minor resistance to flow therethrough, whether occasioned by gravity or another pump, so if a selected pump would offer excessive resistance, a suitable bypass arrangement can be provided when the pump is not running.

Pumps and valves are most commonly operated electrically, but hydraulic or pneumatic actuation may be substituted. It is usually inconvenient, though it may be possible, to rely upon on-site manual operation of valves. No attempt is made in the accompanying drawings to show interconnection of electrical, hydraulic, or pneumatic lines for—or to—pumps or valves, as appropriate means and methods for doing so will be obvious to persons ordinarily skilled therein.

No unusual materials are required for practicing this invention although conventional materials may be modified or new ones be devised. Non-foraminous plastic pipe may be slotted or notched, or it may be perforated in any suitable manner, to provide embodiments of foraminous piping suitable for the practice of this invention. Diverse styles of foraminous pipe may be filled with granular or pebbly material to weigh it down into position and to hold it in such position, and to aid in excluding undesired organic/inorganic contaminants from entering the pipes. Otherwise, metal piping may be employed, with or without such filling material inside it.

For low cost and ready handling, plastic pipe is preferable to metal pipe at least some, if not all, of the time. Appropriate compositions include high-density polyethylene (HDPE) or polypropylene (HDPP) and polyvinyl chloride (PVC). In some heavy-duty uses, epoxy pipe reinforced with glass-fibers is another possible choice. End-to-end attachment may be accomplished by use of sleeves or bands of similar or dissimilar material assembled with surrounding end-to-end sleeves or bands clamped or sealed about juxtaposed ends of pipes.

If foraminous plastic piping is not available, perforated plastic sheets may well be or non-foraminous sheets can be either folded or rolled to juxtapose opposite edges into cylindrical form and be seamed along juxtaposed edges by adhesive or heating for ready conversion into piping.

Operation of the apparatus of the invention to practice methods of the invention will be apparent from the foregoing description and the accompanying diagrams, in the light of the following summary of respective operating modes illustrated in FIGS. 4 to 9. Of course, most of the time the apparatus is held in stand-by condition, not actually transferring any water but ready to do so as required.

Dewatering and/or fluidization will be practiced periodically, dependent upon usual diurnal and seasonal variations of water level, wave intensity, wind velocity, and alongshore or other currents—and will be modified aperiodically, as advisable in the event of stormy or other abnormal conditions. In FIGS. 4 to 9, dewatering flow is indicated by vertical arrows pointing upward to the wall of one or more of the foraminous pipes, and fluidization is indicated contrariwise by vertical arrows pointing downward from the wall of one or more of the foraminous pipes. In any given view, solid arrows indicate positive use, whereas broken arrows indicate optional use. Arrows directed to and/or from the ends of non-foraminous piping indicate flow to or from man-made storage means, or offshore waters.

Figure 4:
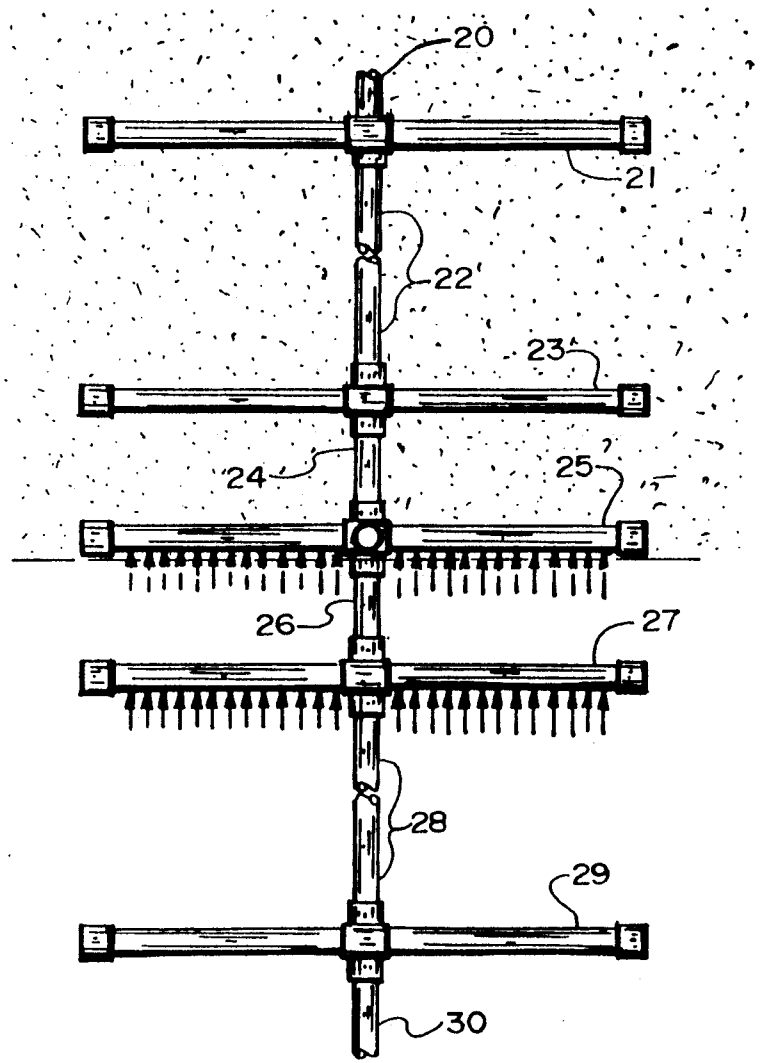
FIG. 4 is a plan view similar to FIG. 2, including flow arrows for a first given mode of operation according to this invention.

FIG. 4 shows a simple dewatering mode for fair weather periods. Solid up arrows into near offshore foraminous pipe 27 and broken up arrows into intertidal zone foraminous pipe 25 indicate dewatering. With reference to FIG. 3, if only pipe 27 is dewatering, pump P4 operates to bring water from the adjacent subsoil into pipe 27 via open side valves 27A, 27C, with upstream valve 27D closed, and send it through pipe 28 and open valves 29D and 29B (side valves 29A and 29C being closed) to discharge through outlet pipe 30 into offshore waters. If pipe 27 is also dewatering, its side valves 27A and 27C are open, but upstream valve 27D is closed, and pump P3 operates to draw in the water and send it through open valves 25C and 27D and on the same as just described for dewatering with foraminous pipe 27.

Figure 7:
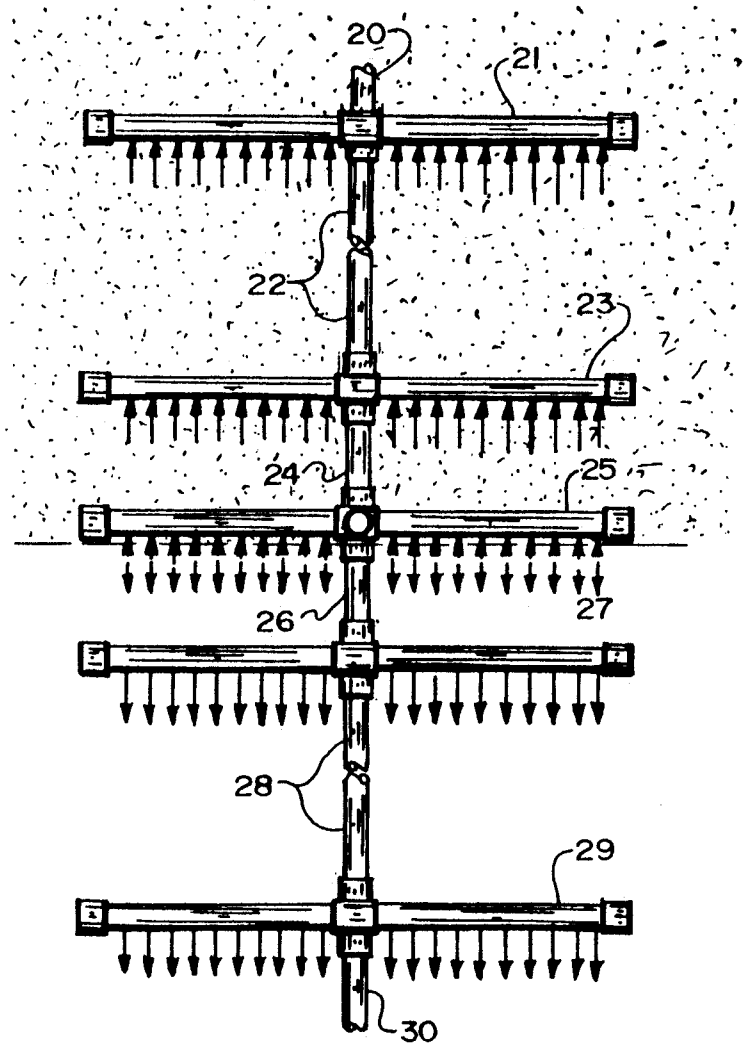
FIG. 7 is a plan view similar to FIG. 2, including flow arrows for a fourth given mode of operation according hereto.
Figure 9:
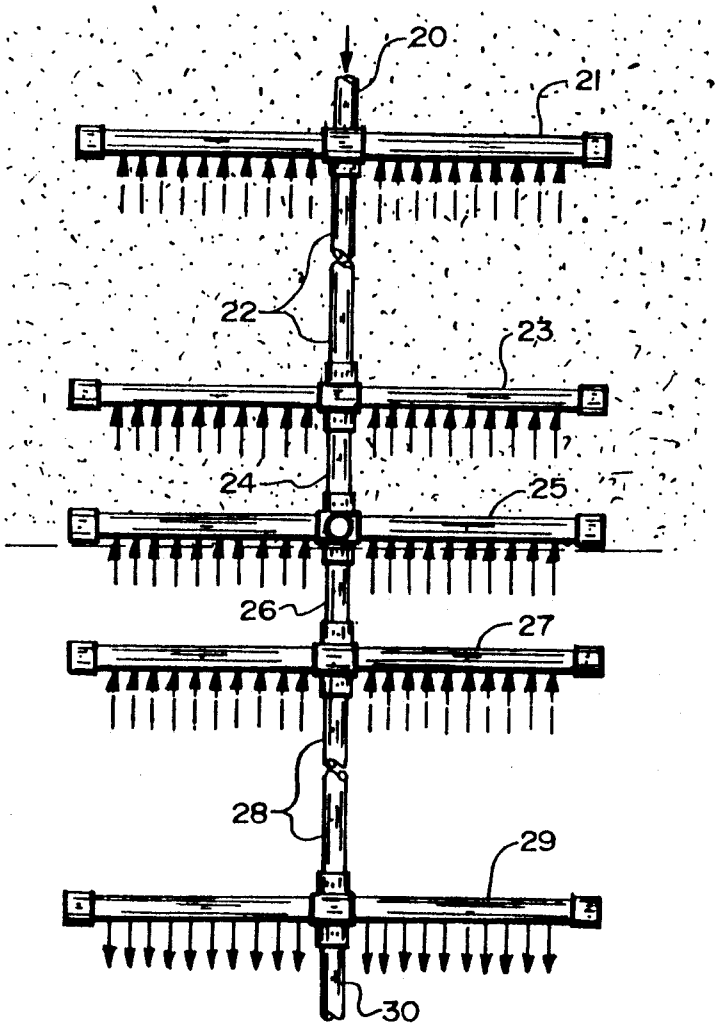
FIG. 9 is a plan view similar to FIG. 2, including flow arrows for a sixth given mode of operation according to this invention.
Figure 8:
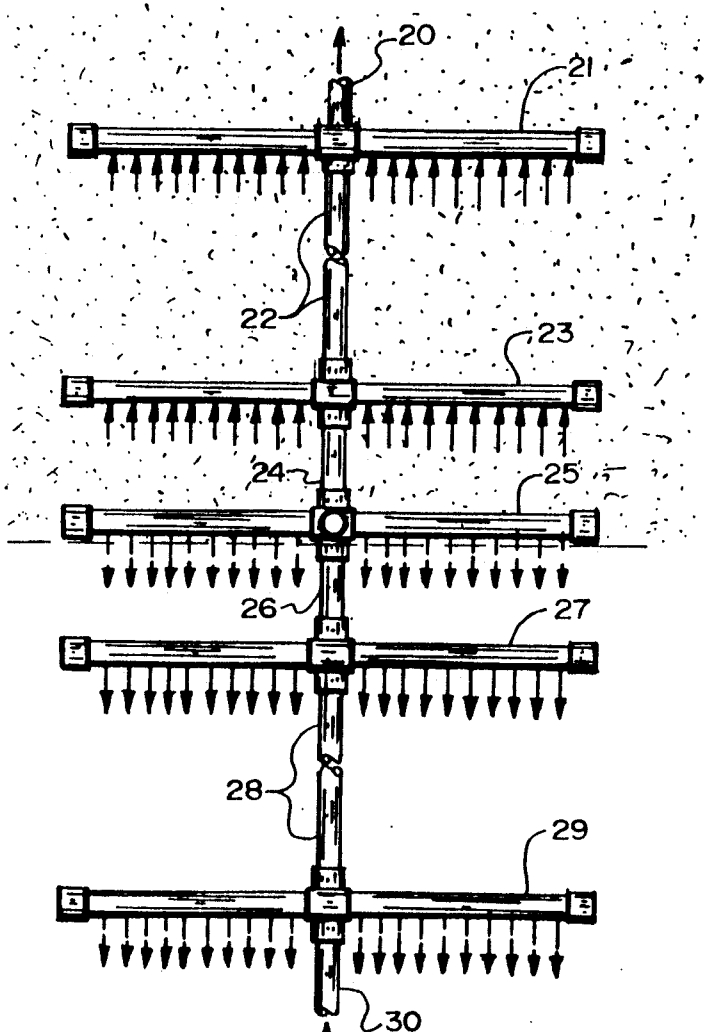
FIG. 8 is a plan view similar to FIG. 2, including flow arrows for a fifth given mode of operation according hereto.

FIGS. 5 to 9 represent operating modes ranging from similarly mild weather conditions, much as in FIG. 4, through increasingly stronger weather to FIG. 8, and then an after-storm mode in FIG. 9.

Figure 5:
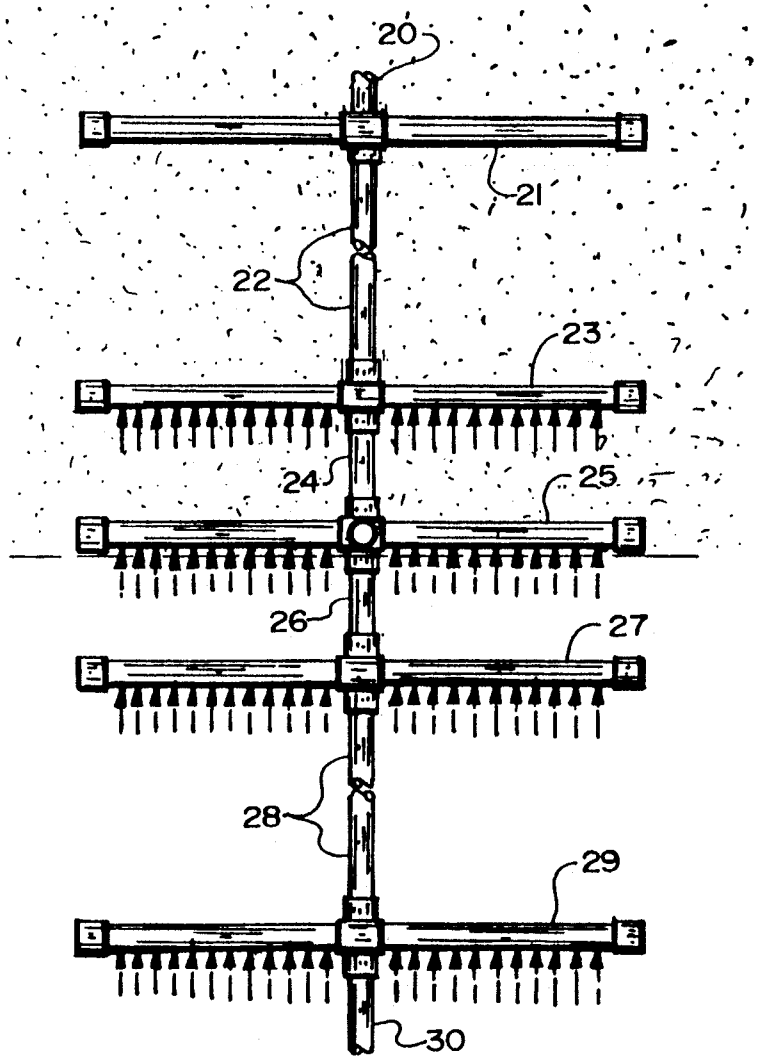
FIG. 5 is a plan view similar to FIG. 2, including flow arrows for a second given mode of operation according hereto.

FIG. 5 shifts the dewatering balance from near offshore to near onshore and provides optional fluidization in the far offshore area. Thus, dewatering occurs via near onshore foraminous pipe 23, and optionally via either or both pipes 25 and 27 in much the same mode as in FIG. 4. Of course, the appropriate valves are set accordingly by reference to FIG. 3. If the optional fluidization is selected, the water required can either be obtained from the dewatering, in which event one or both of the optional additional dewatering pipes will prove helpful. Otherwise, either valve 29 one or both of valves 27B and/or 29D should be closed, and pump P5 be operated to draw water in from offshore via inlet pipe 30.

Figure 6:
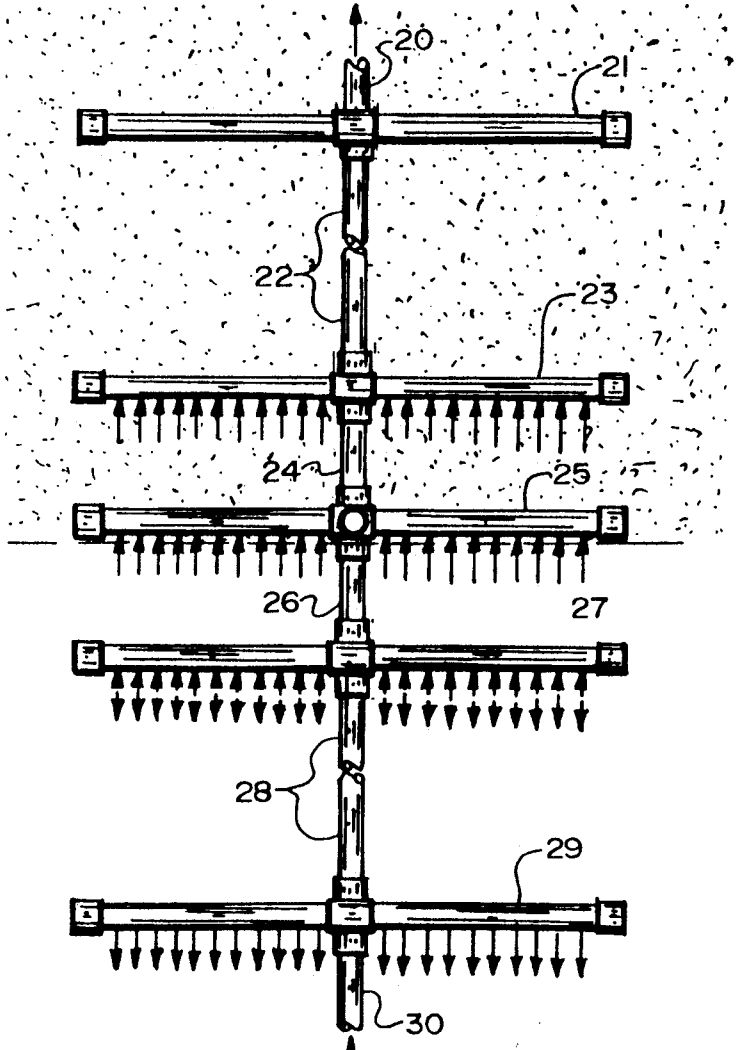
FIG. 6 is a plan view similar to FIG. 2, including flow arrows for a third given mode of operation according hereto.

FIG. 6 provides a plurality of dewatering pipes (23 and 25) and offshore fluidization via pipe 29, with foraminous pipe 27 used as a swing pipe optionally dewatering or fluidizing, as may be preferred, in order to cope with an incipient storm condition. The valving is reset by reference to FIG. 3, including opening valves 21B and 21D (with valves 21A and 21C closed) to enable water to be pumped, as by pump P1, to temporary storm storage.

FIG. 7 shows an operational mode for a more stormy condition in which foraminous pipe is used to dewater further onshore (valves 21A and 21C opened). Foraminous pipe 23 is used to dewater as in preceding views, and foraminous pipe 25 assumes the swing position, either dewatering or fluidizing as required, while both offshore foraminous pipes 27 and 29 are also fluidizing.

In the stormiest operating mode, shown in FIG. 8, optional far offshore fluidization may be discontinued as ineffectual, and only onshore foraminous pipes 21 and 23 are dewatering, while foraminous pipe 27 is fluidizing the subsoil nearest to them, and far offshore foraminous pipe is optionally fluidizing but may be discontinued as now too far from the most important region.

FIG. 9 represents a clean-up operating mode after cessation of a storm. Accumulated water is released from storm storage via pipe 20 (with in arrow), and flows through the system and out from outlet 30, notwithstanding that foraminous pipe 29 is fluidizing to remove sand bar 54 (FIG. 1) resulting from beach loss. Foraminous pipes 21, 23, 25, and possibly 27 are operating to dewater the subsoil and accrete as rapidly as possible subsoil fluidized by whatever action.

The overall objective is to prevent beach and related erosion by natural forces, especially in extreme regions of their operating spectrum. The foregoing operating modes are not all-inclusive and not necessarily so exclusive as they may appear. Various conditions may require other mixing or matching of dewatering and fluidization.

Although fluidization of non-cohesive subsoil, such as sand, is exemplified above with water as the fluid of choice, air, or a mixture of air and water may be substituted whenever preferable. Air may be supplied through pipe 24 (characterized above as an exhaust pipe for water collected by dewatering the subsoil). Airflow and/or intermittent air and water flow is often helpful in initial removal of excessive deposits of overlying subsoil or other obstructions.

The invention is exemplified by the illustrated arrangement of five substantially parallel foraminous pipes linked along a single line of non-foraminous piping, but it will be understood that either or both the foraminous or/and the non-foraminous pipes may have like neighboring piping parallel thereto in a matrix replication thereof, along with additional pumps to assure the desired flow pattern(s). Sizing and distribution of openings in foraminous pipes for desired flow therethrough may vary greatly, as in diverse subsoils. Dewatering pipes may have openings uniformly distributed throughout, whereas fluidizing pipes may have openings mainly (or exclusively) at the sides because lower openings tend to settle the pipe into the subsoil, whereas higher openings enable the fluid to escape upward quickly and with reduced overall fluidizing effect. A multi-purpose pipe (e.g., one functioning part of the time for dewatering and part of the time for fluidization) is almost by definition suited less well to either such use than are pipes tailored to one or the other.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

I claim:

1. Coastal stabilization apparatus, comprising a substantially horizontal array of foraminous-walled piping means at or below the subsoil surface, including one such piping means at about maximum storm runup onshore as viewed in plan, each piping means in the array being oriented generally parallel to the shoreline, being adapted to interchange water via its foraminous wall openings with adjacent non-cohesive subsoil, being interconnected via valved non-foraminous piping means, and connected to pumping means whereby the respective foraminous means are adapted to dewater or to fluidize subsoil adjacent thereto and at least one such piping means offshore adapted to interchange water with the adjacent body of water via an interconnected valved inlet/outlet pipe directed further offshore.

2. Coastal stabilization apparatus according to claim 1, including foraminous piping means located at at least four sites, including at least one additional onshore site and at least one offshore site.

3. Coastal stabilization apparatus according to claim 1, including foraminous piping means located at an intertidal site.

4. Coastal stabilization apparatus according to claim 1, including foraminous piping means located at at least two onshore sites and at least two offshore sites.

5. Coastal stabilization apparatus according to claim 2, including foraminous piping means located at an intertidal site between the onshore and offshore sites.

6. Coastal stabilization apparatus according to claim 1, including water storage means interconnected to the foraminous piping means to receive water from certain or such piping means when the same is dewatering adjacent subsoil and to supply water to certain of such piping means when the same is fluidizing adjacent subsoil.

7. Coastal stabilization apparatus, convertible between a normal mode of operation useful during good weather and an emergency mode of operation useful during stormy weather, comprising an array of substantially horizontal and substantially parallel lengths of buried foraminous piping, including at or below the prevailng water at least one such piping length underlying beach land, at least one such piping length underlying an onshore location at about furthest storm runup, and at least one such piping length underlying an offshore location;

piping directly interconnecting the aforesaid piping lengths, flow-control valves at respective piping junctions, and pumping means adapted to provide water interchange into or out from respective foraminous piping lengths from or into adjacent subsoil.

8. Coastal stabilization apparatus according to claim 7, including water storage means interconnected to the furthest onshore foraminous piping length.

9. Coastal stabilization apparatus according to claim 7, wherein the piping length underlying the beach is in an intertidal zone between mean high water and mean low water viewed in plan.

10. Coastal stabilization method, convertible between a normal mode of operation useful during good weather and an emergency mode of operation useful during stormy weather, comprising steps of establishing an array of water-interchange sites buried in non-cohesive subsoil, including a plurality of substantially horizontal parallel linear arrays of such sites, at or below the prevailing water level, at least one such linear array underlying beach land, at least one such linear array underlying an onshore location at about furthest storm runup, and at least one such linear array underlying an offshore location, and comprising also operational steps of providing and controlling water interchange into and out from the respective foraminous linear arrays from or into adjacent subsoil.

11. Coastal region stabilized by the method of claim 10.

12. Coastal stabilization method according to claim 10, also including the step of connecting onshore water storage means to the array so as to receive water from certain of such linear arrays when dewatering subsoil adjacent thereto and so as to supply water to certain of such linear arrays when fluidizing subsoil adjacent thereto.

13. Coastal stabilization apparatus according to claim 10, including the preparatory step of providing an offshore linear array with a further offshore inlet/outlet adapted to interchange water with the adjacent body of water plus the operations steps of taking in water via such offshore inlet as needed for fluidizing subsoil via certain of the linear arrays, and alternatively discharging via such offshore outlet water accumulated from dewatering subsoil via certain of the linear arrays.

14. Coastal stabilization method according to claim 10, including operational valving steps of selecting at which of such linear arrays water-interchange with adjacent subsoil is to take place, and at which of the selected sites said interchange is to dewater adjacent subsoil and at which of the selected sites said interchange is to fluidize adjacent subsoil.

15. Coastal stabilization method according to claim 13, including the steps of reselecting respective linear arrays for dewatering or fluidizing when storm conditions occur or cease.

16. Coastal region stabilized by the method of claim 15.

* * * * *